United States Patent [19]

Pleuse et al.

[11] Patent Number: 5,076,469

[45] Date of Patent: Dec. 31, 1991

[54] DEVICE FOR HEATING A GASEOUS SUBSTANCE

[75] Inventors: Harald Pleuse, Langenfeld, Fed. Rep. of Germany; Peter E. Muller, Reinach, Switzerland

[73] Assignee: Nordson Corporation, Westlake, Ohio

[21] Appl. No.: 184,337

[22] Filed: Apr. 21, 1988

Related U.S. Application Data

[63] Continuation of Ser. No. 928,964, Nov. 10, 1986, abandoned.

[30] Foreign Application Priority Data

Dec. 5, 1985 [SE] Sweden ..... 85115432

[51] Int. Cl.[5] ..... B67D 5/62

[52] U.S. Cl. ..... 222/146.2; 165/907; 431/240

[58] Field of Search ..... 222/146.5, 146.2, 146.1, 222/190, 135; 239/133, 79, 590.3; 431/240, 328; 165/907

[56] References Cited

U.S. PATENT DOCUMENTS

| | | | |
|---|---|---|---|
| 2,974,723 | 3/1961 | Blanchard | 158/27.4 |
| 3,406,905 | 10/1968 | Reilly et al. | 239/84 |
| 3,784,111 | 1/1974 | Piggott | 239/427.3 |
| 3,974,965 | 8/1976 | Miller | 239/413 |
| 4,006,845 | 2/1977 | Scholl et al. | 222/146.5 |
| 4,059,466 | 11/1977 | Scholl et al. | 156/78 |
| 4,059,714 | 11/1977 | Scholl et al. | 428/310 |
| 4,065,057 | 12/1977 | Durmann | 239/79 |
| 4,184,615 | 1/1980 | Wright | 222/190 |
| 4,193,745 | 3/1980 | Hamilton et al. | 418/9 |
| 4,200,207 | 4/1980 | Akers et al. | 222/190 |
| 4,264,214 | 4/1981 | Scholl et al. | 366/103 |
| 4,396,529 | 8/1983 | Price et al. | 252/307 |
| 4,405,063 | 9/1983 | Wydro et al. | 222/146.5 |
| 4,423,161 | 12/1983 | Cobbs, Jr. et al. | 521/73 |
| 4,505,406 | 3/1985 | Cobbs, Jr. et al. | 222/146.5 |

FOREIGN PATENT DOCUMENTS

| | | | |
|---|---|---|---|
| 158097 | 1/1985 | European Pat. Off. . | |
| 2435349 | 2/1976 | Fed. Rep. of Germany . | |
| 3033431 | 3/1982 | Fed. Rep. of Germany . | |
| 3225844 | 1/1984 | Fed. Rep. of Germany . | |
| 937178 | 3/1948 | France . | |
| WO83/04040 | 11/1983 | PCT Int'l Appl. . | |
| 957980 | 9/1982 | U.S.S.R. . | |
| 531112 | 12/1940 | United Kingdom | 165/907 |

*Primary Examiner*—H. Grant Skaggs
*Assistant Examiner*—Kenneth Noland
*Attorney, Agent, or Firm*—Wood, Herron & Evans

[57] ABSTRACT

A device for applying or spraying viscous materials, preferably molten thermoplastic materials, has a discharge nozzle, which is supplied through separate lines with viscous material and heated gas. The supplied gas is conducted to the discharge nozzle by way of a heat exchanger, which contains a sintered metal insert thermally coupled to a heating device.

5 Claims, 2 Drawing Sheets

DEVICE FOR HEATING A GASEOUS SUBSTANCE

This is a continuation of application Ser. No. 928,964, filed Nov. 10, 1986, now abandoned.

The invention pertains to a device for applying or spraying viscous materials, preferably molten thermoplastic materials, through a discharge nozzle, which is supplied by way of separate supply lines with the viscous material and a heated gas.

A device of the type indicated above is known from French Patent No. 937,178. It consists of a hand applicator or spray gun, which is connected by way of a first supply line to a tank which holds and heats a material such as bitumen, asphalt, resin, or wax which is viscous when heated. A second supply line is connected to a compressed air cylinder; whereas a third supply line is an electrical line. The gun barrel contains a tube for holding the material which is viscous when heated; this tube is partially surrounded by an electrical resistance neater which serves to keep the material in the molten state. On the discharge side, the tube is connected to a nozzle channel in the discharge nozzle. The compressed air line leads through the gun handle to a chamber surrounding the tube which holds the material which is viscous in the heated state; this chamber opens in the discharge nozzle into a ring-shaped channel, which surrounds the nozzle channel, so that when a release lever is actuated, the molten material leaves the nozzle channel and is atomized or sprayed by means of the compressed air discharged through the ring-shaped channel. In this known device, the compressed air being supplied is additionally heated by the electrical resistance heater surrounding the tube along which the compressed air is conducted; thus, the air is heated just before spraying.

To heat the compressed air supplied to the hand applicator or spray gun, however, a relatively large chamber or a resistance heating line of sufficiently large dimensions is required to heat the compressed air to the desired degree. This means that the gun barrel must be correspondingly large or that the output rate of the hand applicator or spray gun will be limited, because as soon as the throughput of molten material exceeds a certain value, the compressed air being supplied cannot be heated sufficiently. In most cases it is impossible to increase the heat output of the electrical resistance heater as much as desired, because this would lead to the overheating of the viscous material, which then would no longer have the desired properties when sprayed or atomized. This is especially true when the known hand applicator or spray gun is used to dispense thermoplastic materials, such as hot-melt adhesives, for which a certain discharge temperature is either desirable or necessary.

The problem of the present invention is to provide an applicator device of the type described above in which the compressed gas is heated to a high temperature and provided with optimum turbulence in the least possible amount of space and in the shortest possible time in the applicator.

This problem is solved according to the invention in that the supplied gas is conducted by way of a heat exchanger, which contains a sintered insert thermally coupled to a heating device, to the applicator nozzle.

The solution according to the invention makes it possible to spray viscous material by means of the separate supply of the gas and the viscous material to the applicator nozzle; this ensures that the supplied gas is heated in the applicator device to a higher temperature in the smallest possible space and in the shortest possible time and that it is also provided with optimum turbulence uniformly across the entire cross section of its passage, that is, throughout its entire volume. The applicator according to the invention is especially suitable for the application of molten thermoplastic materials, such as hot-melt adhesives, for which it must be ensured by the heating of the gas that the molten thermoplastic material does not cool prematurely before it is applied. By heating the supplied gas immediately in the applicator, heat losses during supply of the gas are prevented, and in addition it is ensured that a certain gas temperature which is optimum for the application or spraying of the thermoplastic material can be maintained; the turbulence ensures that the entire volume of gas is heated uniformly, and in the case of gas mixtures, that the mixture is heated uniformly.

An advantageous embodiment of the solution according to the invention is characterized in that the heating device consists of a sintered metal block, in which a hole is provided for an electrically heated heat cartridge.

A sintered metal block is used, which can consist, for example, of sintered iron. Powdered or finely divided iron is compressed, graded, and broken into pieces. Then possibly after a preceding molding operation, such as by pressing, the material is heated, and as a result of the high temperature and the resulting reactions at the interfaces, the individual grains of the starting material are welded to each other to form a single mass of gas-permeable agglomerate. In this way, the maximum surface area for the dissipation of heat from a heat cartridge to the gas flowing through the sintered metal block is obtained in the smallest possible volume. The sintered metal block can be installed directly in the applicator or attached as a module or cartridge, so that the gas supplied to the applicator is heated with maximum efficiency.

In place of a sintered metal block, the heating device can contain a hollow cylindrical sintered metal insert, which surrounds an electrically heated cylindrical heat cartridge. To increase the heat output, additional electrically heated heat cartridges can be provided around the sintered metal insert, so that the hollow cylindrical sintered metal insert is heated both from the inner surface of the hollow cylinder and from the outer surface of the hollow cylinder of the sintered metal insert.

Another advantageous design of the solution according to the invention is characterized in that the heat exchanger contains a heating block, in the center of which the first heat cartridge and the heat pipe surrounding the first cylindrical heat cartridge and the hollow cylindrical sintered metal insert are arranged, and in that at least one additional heat cartridge is provided outside the hollow cylindrical sintered metal insert within the heating block, where the heating block can contain a hole for the passage of the viscous material and a thermostat.

Another advantageous embodiment of the invention for a hand applicator gun with a housing which has a barrel and a grip, with an applicator nozzle, and with a release lever for manual control of the discharge rate, is characterized by a heat exchanger adapter which can be connected to the gun barrel; on the inlet side, this adapter is connected to a gas supply line and to an electrical line, and it contains a heat exchanger inlet plate connected to the heat exchanger on the one side and to the gas supply line and the electrical line on the other and a heat exchanger cover connected to the heat exchanger on the one side and to an adapter mount on the other, the adapter mount being attachable to the gun barrel. Preferably, the heat exchanger can have in the longitudinal direction a continuous hole for the viscous material, this hole being connected by way of the heat exchanger cover and the adapter mount to a line for supplying the viscous material to the applicator nozzle while the gaseous substance is conducted through the heating block of the heat exchanger and discharged through a gas hose directly to the applicator nozzle.

With this design of the solution according to the invention, the heat exchanger is attached in the form of an adapter or cartridge to a hand applicator gun, so that, with minimal space requirements and only a slight increase in weight, it is ensured that the handgrip does not heat up and that the hand applicator gun is easy to handle. In addition, the advantages described above are secured, namely, the advantages associated with a high-efficiency heat exchanger.

An additional advantageous embodiment of the solution according to the invention for a spray head for dispensing a mixture of a viscous material and a gaseous substance, which are supplied separately to the spray head through supply lines and are dispensed through an applicator nozzle after they have been mixed together, is characterized in that the heat exchanger is installed in the spray head and is connected by way of an inlet plate to the supply lines for the gas and the viscous material and to an electrical line connected to at least one heat cartridge of the heat exchanger and by way of a heat exchanger cover to the applicator nozzle.

This embodiment of the solution according to the invention is especially suitable for a spray head which can be attached to any desired applicator device and ensures the advantages described above associated with the heat exchanger according to the invention. This variant also guarantees that the applicator device to be provided with the spray head can be operated in various ways, such as in an airless manner or with compressed air.

On the basis of an exemplary embodiment illustrated in the drawings, the basic idea on which the invention is based will be explained in more detail:

Figure 1:
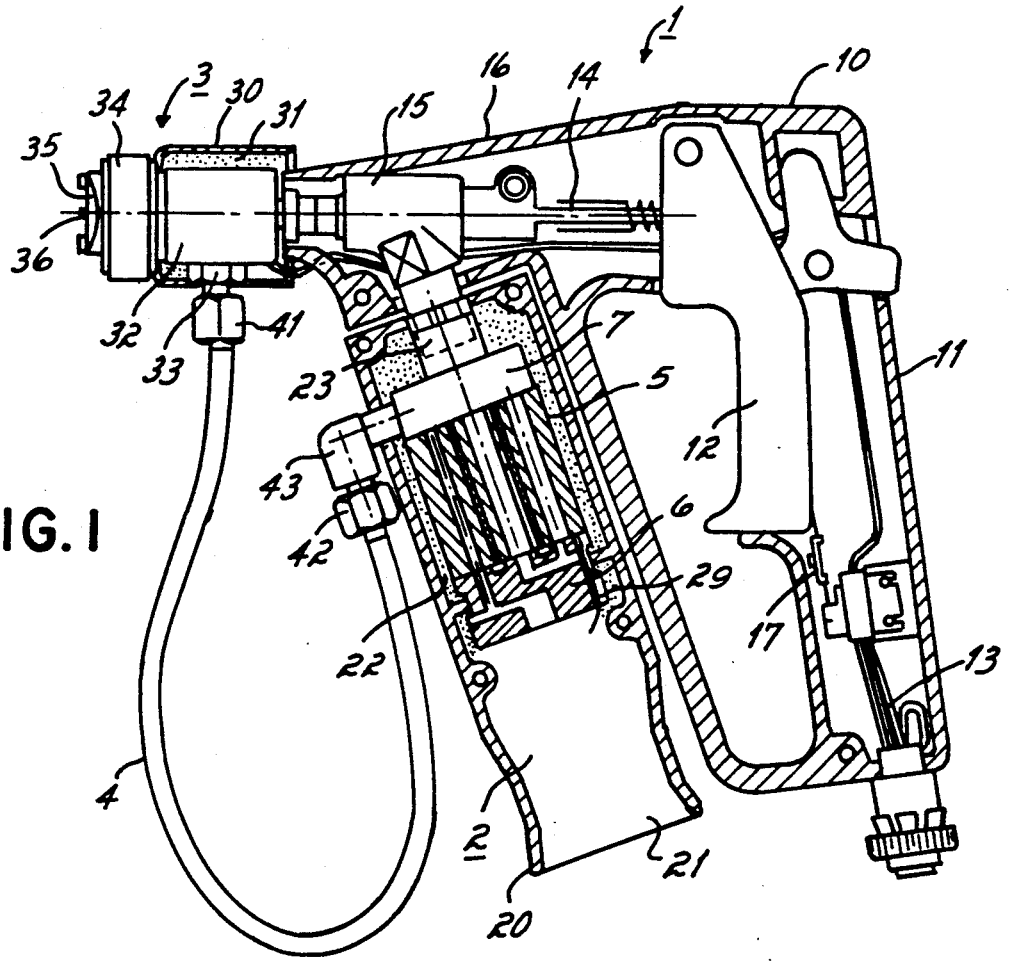
FIG. 1 shows a cross section through a hand applicator gun with a heat exchanger adapter with a sintered metal insert.

The cross section shown in FIG. 1 through a hand applicator gun 1 for applying viscous materials mixed with a compressed gas, preferably a mixture of a thermoplastic material and compressed air, has a gun housing 10 and consists essentially of a gun grip 11 and a gun barrel 16, at the front end of which an applicator nozzle 3 is attached and at the lower part of whose housing a heat exchanger adapter 2 is attached. In the embodiment illustrated, the heat exchanger adapter 2 is attached to a sealing mechanism 15 in such a way that it is essentially parallel to the gun grip 11.

The hand applicator gun 1 comprises essentially a release lever 12 for actuating the sealing mechanism 15 by way of a release mechanism 14, a microswitch 17 for actuating a magnetic valve for controlling the supply of the gas to the heat exchanger adapter 2, and an electrical line 13, which leads both to the microswitch 17 and to a heatable nozzle holding element installed in applicator nozzle 3. The sealing mechanism 15, which is known in itself, contains a sealing piston leading to applicator nozzle 3; this piston can be put in motion by way of the release mechanism and release lever 12, and when release lever 12 is actuated, the piston makes it possible for the viscous material and the heated gas to emerge.

Applicator nozzle 3 contains the heated nozzle holder 32 into which the viscous material, conducted through sealing mechanism 15, enters on one side and into which a heated gas also enters through a gas connection 33; the holder is thermally insulated from the surroundings by means of insulating material 31 and a nozzle cover 30. The heated gas being supplied and the viscous material heated in the heatable nozzle holder 32 meet in the spray head, which is attached by means of a cap nut 34. The two emerge in the desired form from a discharge nozzle 36, the discharge nozzle 36 being covered by a cap 35. Any desired application structures can be achieved by controlling the pressure of the gas supply, the viscosity of the material, and the temperature in the area of the discharge nozzle; for example, a net like or thread-shaped application structure of the gas/material mixture can be obtained, or a droplet structure, etc.

In the exemplary embodiment presented above, both the viscous material and the gas are supplied to the heat exchanger adapter 2 by way of an adapter supply opening. Heat exchanger adapter 2 consists of an adapter housing 20, which is preferably cylindrical in shape, and, next to the inlet opening 21, a first opening for the connection of heat exchanger adapter 2 to gun barrel 16 or for the supply of the viscous material to the heatable nozzle holder, and a second opening for the installation of an elbow piece, through which the heated gas is connected by way of a first hose connector 42, a gas hose 4, and a second hose connector 41 to the heatable nozzle holder.

Inside heat exchanger adapter 2 there is a heat exchanger heating block 5, which is connected on the inlet side to a heat exchanger inlet plate 6 and on the outlet side to a heat exchanger cover 7. Heat exchanger cover 7 is connected in turn to the adapter mount 23, which can be connected by means of a screw, plug, or bayonet joint to sealing mechanism 15 inside gun barrel 16.

In addition to the supply lines for the viscous material and the compressed gas, an electrical line 29 is also provided, which leads to heat exchanger heating block 5.

The details of the design of the heat exchanger inside heat exchanger adapter 2 are explained below with reference to the drawing in FIG. 2.

Figure 2:
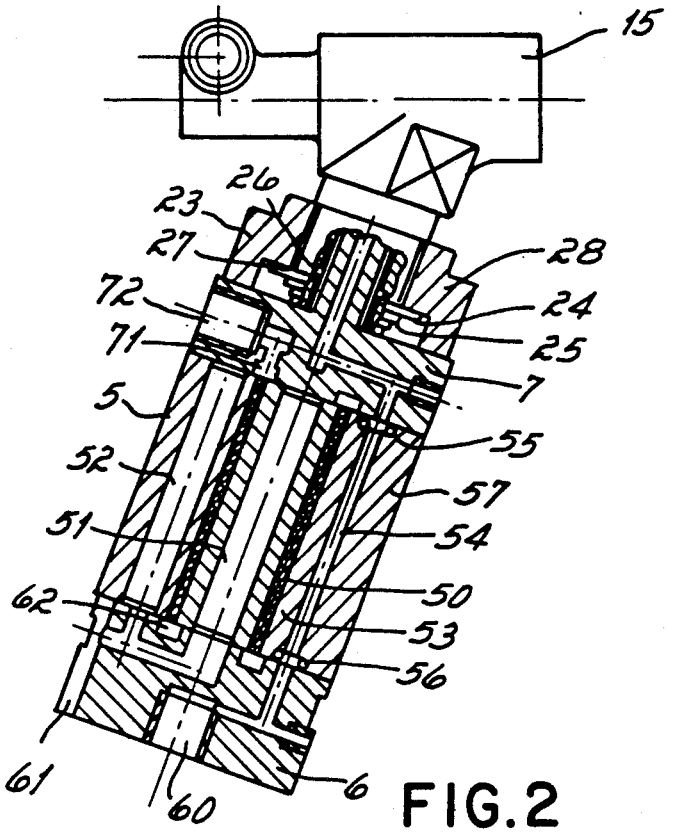
FIG. 2 shows a detailed illustration of the heating block with the adapter mount of the heat exchanger adapter according to FIG. 1.

The heat exchanger, shown approximately in natural scale in FIG. 2, has a heat exchanger heating block 5, a heat exchanger inlet plate 6, and a heat exchanger cover 7 connected by way of adapter mount 23 to sealing mechanism 15; these elements are also present in FIG. 1 and are provided with the same reference numbers there.

The cylindrical heat exchanger heating block 5 has in the center a first heat cartridge 51 and a heat pipe 53 consisting of, for example, aluminum, surrounding the first heat cartridge 51. Heat pipe 53 is surrounded by a hollow cylindrical sintered metal insert 50, whose cylindrical outer surface is inserted into a bore in heating block 5. In addition, heating block 5 has a hole 54 for the viscous material and an additional hole for holding a second heat cartridge 52.

The two heat cartridges 51, 52 operate on the principle of electrical resistance heating and are connected to a control device by electrical lines (not shown); this control device regulates the supply of current to the heat cartridges 51, 52 to a preset nominal value as a function of the actual temperature recorded by means of a thermostat (not shown).

Of course, additional heat cartridges can also be provided in holes in heating block 5 in addition to the first and second cartridges. The electrical lines leading to heat cartridges 51, 52 are conducted through holes 61 in the heat exchanger inlet plate.

The viscous material conveyed through heating block 5 passes through a hole 60 in heat exchanger inlet plate 6; inlet hole 60 is either in alignment with hole 54 for the viscous material leading through the heating block 5 or is connected by means of appropriate connecting holes in alignment with the hole for the viscous material 54 in heating block 5. The same is true for the hole leading on through heat exchanger cover 7, through which the viscous material is conducted to sealing mechanism 15 and to applicator nozzle 3. To seal hole 54 against the heat exchanger inlet plate connected to heating block 5 and heat exchanger cover 7 connected to heating block 5, 0-rings 55, 56 are provided.

Heat exchanger inlet plate 6 has in addition a circular groove 62, which is provided in the surface of heat exchanger inlet plate 6 connected to heating block 5 and is aligned with the hollow cylindrical sintered metal insert 50 of heating block 5. A hole (not shown) leads from this groove 62 to the other side of the heat exchanger inlet plate, so that the gas to be heated, which is conducted through a supply line to heat exchanger adapter 2 according to FIG. 1, can enter the heat exchanger.

Heat exchanger cover 7 also has a circular gas outlet groove 71, which, like groove 62 of heat exchanger inlet plate 6, is aligned with hollow cylindrical sintered metal insert 50 in heating block 5 and which is slightly wider than sintered metal insert 50. Ring-shaped gas outlet groove 71 is also connected by means of a hole to a gas outlet 72, which is connected according to FIG. 1 by means of elbow 43 and hose connector 42 and gas hose 4 and the other hose connector 41 and gas connection 33 to heatable nozzle holder 32.

Adapter mount 23 contains a sealing disk 24, a Seeger ring 25, a support ring 26, and an O-ring 27, which are placed around a cylindrical projection on heat exchanger cover 7. Sealing disk 24 is supported in addition on the insulation 28 of adapter mount 23.

In the following, the way in which the hand applicator gun for molten thermoplastic material operates is explained in more detail.

The thermoplastic material, which is melted, for example, in a melting tank, is conveyed through a supply line (not shown) to heat exchanger inlet plate in adapter unit 2; this line is connected by means of an appropriate threaded connector to inlet hole 60 in the heat exchanger inlet plate. Compressed air, for example, is also conducted through a supply line (not shown) to the hole in heat exchanger inlet plate connected to inlet groove 62. The molten thermoplastic material passes through continuous hole 54 and the corresponding hole in heat exchanger cover 7 to sealing mechanism 15. When release switch 12 is actuated, the molten thermoplastic material reaches heatable nozzle holder 32, and from there it passes on through the mixing head to the discharge nozzle 36.

The compressed air to be heated which is supplied to the heat exchanger passes through inlet groove 62 and through the sintered metal insert 50, arriving at outlet groove 71, whereupon it passes through gas outlet 72 and gas hose 4 and also arrives ultimately at heatable nozzle holder 32, where the heated compressed air is mixed with the molten thermoplastic material; then the mixture is discharged through discharge nozzle 36. Microswitch 17 for the magnetic valve closing the gas supply line controls the supply of compressed air to heat exchanger 2, so that, when release lever 12 is actuated, compressed air can pass through heat exchanger 2 and gas hose 4 to arrive at applicator nozzle 3.

The gas-permeable sintered metal insert 50 is characterized in that a maximum surface area for heating the gas or compressed air conducted through heat exchanger 2 is provided in the minimum volume and that therefore the gas or compressed air is heated with optimum efficiency. The width of the sintered metal insert depends essentially on the gas throughput and the difference between the desired gas outlet temperature and the gas inlet temperature, as well as on the heating power of the heat cartridges 51, 52.

As a variant of heat exchanger 2 shown in FIGS. 1 and 2, instead of a hollow cylindrical sintered metal insert 50, it is also possible to use a sintered metal block, which contains one or more holes for one or more heat cartridges and which is connected at its bottom and top surfaces to corresponding plates, which have one hole each for receiving a gas supply line or a gas outlet line. In an exemplary embodiment of this type, the viscous material or the molten thermoplastic material can, for example, be conducted around the sintered metal block, or alternatively, it can be conducted by way of the gun grip and gun barrel or only by way of the gun barrel to applicator nozzle 3.

The exemplary embodiment shown in FIGS. 3–6 represents a heat exchanger spray head which can be used anywhere and which, for example, can also be mounted on a hand applicator gun according to FIG. 1 in place of the conventional applicator nozzle. Alternatively, the heat exchanger spray head can also be attached to any other applicator device and connected to appropriate supply lines for the viscous material and the compressed gas and to an electrical line.

Figure 3:
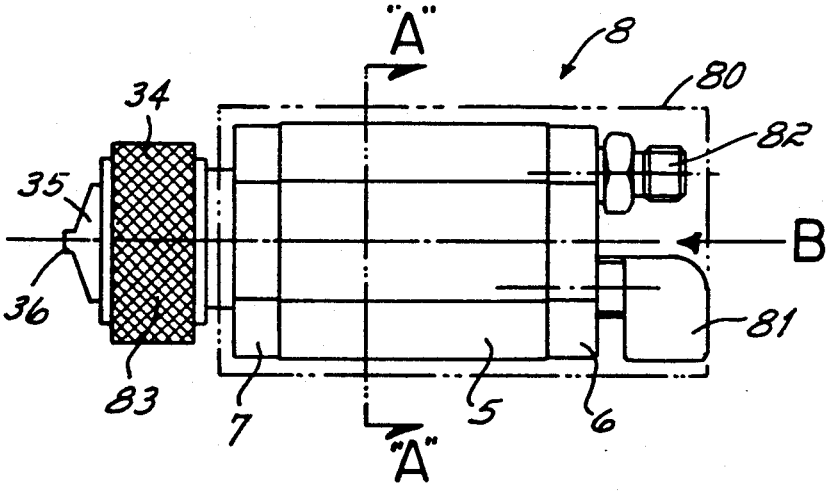
FIG. 3 shows a side view of a heat exchanger spray head.

The side view shown in FIG. 3 of the heat exchanger spray head 8 shows a cover (in broken line) 80, between which and the actual heating block 5 additional thermal insulation can be provided. Heating block 5 of the heat exchanger is connected on the one side to a heat exchanger inlet plate 6 and on the other side to a heat exchanger cover 7 similar to the heat exchanger adapter according to FIGS. 1 and 2. Heat exchanger inlet plate 6 is provided on the inlet side with a gas inlet 81 and an inlet 82 for the viscous material to be sprayed.

Heat exchanger cover 7 is connected to a mixing head 83, which is connected by means of a cap nut 34 to the heat exchanger cover or to a corresponding adapter mount (not shown). Mixing head 83 leads to a discharge nozzle 36, which is covered by a cap 35.

Figure 4:
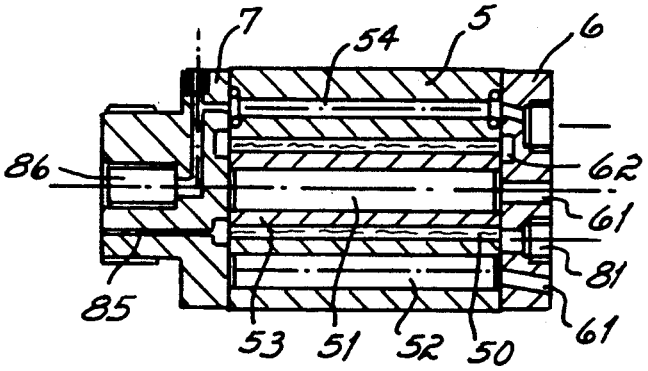
FIG. 4 shows a longitudinal view through the heat exchanger spray head according to FIG. 3.

The longitudinal section of FIG. 4 through the heat exchanger according to FIG. 3 shows, like the diagram of the heat exchanger according to FIG. 2, the internal structure of cylindrical heating block 5, of heat exchanger inlet plate 6, and of heat exchanger cover 7. In the center of heating block 5 is a hole which receives the first heat cartridge 51, heat pipe 53, and sintered metal insert 50 pushed over heat pipe 53. An additional hole 54 allows the viscous material to be sprayed to pass through. Additional holes can be provided for additional heat cartridges; in the diagram of FIG. 4, one additional hole is provided for a second heat cartridge 52.

Heat exchanger inlet plate 6 has a first inlet hole for supplying the gas to be heated, which is conducted through a circular groove 62 to the sintered metal insert. A second inlet 82 serves to supply the viscous material, whereas holes 61 hold electrical lines connected to heat cartridges 51, 52. On the outlet side, an outlet groove 71 is also provided in heat exchanger cover 7; this groove is adapted to the diameter of the sintered metal insert 50 of heating block 5 and leads through a hole 85 to mixing head 82. An additional hole 86 serves to discharge or conduct the viscous material to mixing head 83.

Figure 5:
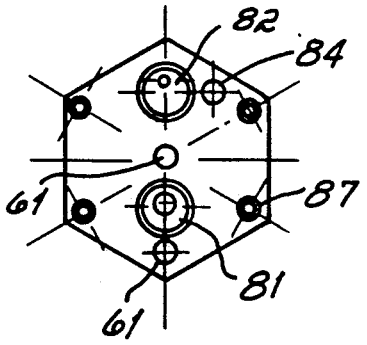
FIG. 5 shows a view of the heat exchanger spray head in the direction of arrow B drawn in FIG. 3.

FIG. 5 shows a top view of the inlet side of the heat exchanger spray head in the direction of arrow B entered on FIG. 3; the fittings for connecting the gas and material supply lines have been omitted for the sake of clarity. The housing of the heat exchanger spray head, which has a hexagonal shape, contains a first hole 81 for supplying the gas to be heated and a second hole 82 for supplying the viscous material to be sprayed. Additional openings 61 serve to hold electrical lines for connecting to heat cartridges 51, 52. Finally, a hole 84 holds a thermostat or resistance sensor, by means of which the temperature in heating block 5 can be measured. Threaded holes 87 serve to connect heat exchanger inlet plate 6 to heating block 5.

Figure 6:
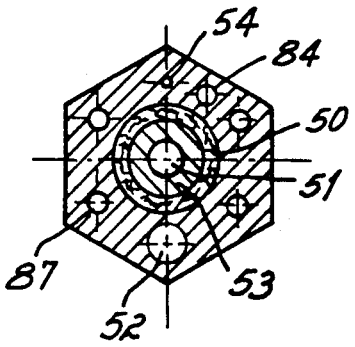
FIG. 6 shows a cross section along line A—A of the heat exchanger spray head according to FIG. 3.

FIG. 6 shows a cross section through the heat exchanger spray head along line A—A of FIG. 3. In this cross-sectional view, the hollow cylindrical sintered metal insert 50 can be seen as it surrounds heat pipe 53 and the first heat cartridge 51. The second heat cartridge 52 is in the lower half of the heat exchanger, whereas in the upper half, hole 54 is provided to allow passage of the viscous material. In this area there is also a hole provided for thermostat 84. The four holes 87 serve to connect heating block 5 to heat exchanger cover 7 and heat exchanger inlet plate 6. As for the functioning of the hand applicator gun according to FIGS. 1 and 2 described above, here, too, the gas to be heated, such as compressed air, is forced as in the case of the heat exchanger spray head according to FIGS. 3-6 through sintered metal insert 50 to arrive at mixing head 83, where it is either mixed with the viscous material or used to spray the viscous material. The viscous material itself enters through inlet opening 82, passage hole 54, and outlet opening 86, finally arriving at the discharge nozzle where it is sprayed through nozzle 36.

In this exemplary embodiment, too, the sintered metal insert 50 can be replaced by a sintered metal block, one or more holes in the sintered metal block serving to hold the corresponding heat cartridges. The viscous material itself can be conducted around the actual heat exchanger spray head and then to the discharge nozzle.

In addition to the sintered metal inserts described above, it is also possible to use appropriately designed sintered ceramic elements or the like, if the intended uses and a certain type of temperature behavior make this necessary. Mixtures and composites of sintered metal and sintered ceramic can also be used where appropriate.

We claim:

1. Apparatus for dispensing molten thermoplastic materials, which apparatus comprises a dispenser and means for supplying the molten thermoplastic material and a gas to the dispenser by separate feed lines, the means for supplying the gas to the dispenser including a heat exchanger, said heat exchanger including means for maximizing the heat transferred to the gas by a minimal size of heat exchanger, said last names means comprising a sintered insert and a heating device for heating said sintered insert, said heat exchanger defining a flow path for the gas through said heat exchanger, and said heated sintered insert being located in said flow path, said heating device comprises an electrically heated cylindrical heat cartridge mounted within said heat exchanger, said sintered insert comprising a hollow cylindrical sintered metal insert surrounding said heat cartridge, a heat pipe located between said cylindrical heat cartridge and said hollow cylindrical sintered metal insert, and further comprising a heating block, said heat cartridge being located in the center of said heating block, said heat pipe surrounding said cylindrical heat cartridge, and said hollow cylindrical sintered metal insert surrounding said heat pipe, said heat exchanger further including at least one additional heat cartridge mounted within said heating block and spaced radially outwardly from said hollow cylindrical sintered metal insert.

2. The apparatus of claim 1 wherein said heating block has a hole through which the molten thermoplastic material is conducted.

3. Apparatus for dispensing molten thermoplastic materials, which apparatus comprises a dispenser and means for supplying the molten thermoplastic material and a gas to the dispenser by separate feed lines, the means for supplying the gas to the dispenser including a heat exchanger, said heat exchanger including means for maximizing the heat transferred to the gas by a minimal size of heat exchanger, said last named means comprising a sintered insert and a heating device for heating said sintered insert, said heat exchanger defining a flow path for the gas through said heat exchanger, and said heated sintered insert being located in said flow path, and comprising a hand-held applicator gun having a housing, a gun barrel, a handgrip, an applicator nozzle, and a release lever for manual control of the rate of discharge of molten thermoplastic material from said applicator nozzle, said apparatus further including a heat exchanger adapter which is adapted to be connected to said gun barrel, said heat exchanger including a heat exchanger inlet plate having means thereon for connection to a gas supply line and an electrical line, said heat exchanger further including a heat exchanger cover connected to an adapter mount, said adapter mount being attachable to said gun barrel.

4. The apparatus of claim 3 wherein said heat exchanger has a passage for the molten thermoplastic material, this passage being adapted to be connected by way of said heat exchanger cover to a source of molten thermoplastic material and by way of said adapter mount to a line for supplying the molten thermoplastic material to said applicator nozzle, and means including a gas hose for conducting gas from said flow path of said heat exchanger directly to said applicator nozzle.

5. Apparatus for dispensing molten thermoplastic materials, which apparatus comprises a dispenser and means for supplying the molten thermoplastic material and a gas to the dispenser by separate feed lines, the means for supplying the gas to the dispenser including a heat exchanger, said heat exchanger including means for maximizing the heat transferred to the gas by a minimal size of heat exchanger, said last named means comprising a sintered insert and a heating device for heating said sintered insert, said heat exchanger defining a flow path for the gas through said heat exchanger, and said heated sintered insert being located in said flow path, and comprising a spray head to which gas and molten thermoplastic material are supplied separately through feed lines, said dispenser including a discharge nozzle, said heat exchanger being contained in said spray head and being connected by way of an inlet plate of said heat exchanger to said supply lines for gas and for molten thermoplastic material and to an electrical line connected to said heating device of said heat exchanger, said heat exchanger being connected by way of a heat exchanger cover to said applicator nozzle.

* * * * *

UNITED STATES PATENT AND TRADEMARK OFFICE

CERTIFICATE OF CORRECTION

PATENT NO. : 5,076,469

DATED : December 31, 1991

INVENTOR(S) : Harald Pleuse et al

It is certified that error appears in the above-identified patent and that said Letters Patent is hereby corrected as shown below:

Column 1, line 21, "neater" should be --heater--.

Column 5, line 66, after "inlet plate", insert --6--.

Column 6, line 3, after "inlet plate", insert --6--.

Column 7, line 26, "head 82" should be --head 83--.

Column 8, line 18, "names" should be --named--.

Column 8, line 32, before "further", insert --said heat exchanger--.

Column 8, line 57, before "comprising", insert --said dispenser--.

Column 10, line 7, before "comprising", insert --said dispenser--.

Signed and Sealed this

Twelfth Day of October, 1993

Bruce Lehman

*Attest:*

BRUCE LEHMAN

*Attesting Officer*

*Commissioner of Patents and Trademarks*